United States Patent [19]

Grennard

[11] 4,121,429

[45] Oct. 24, 1978

[54] UNDERGROUND STORAGE FOR COLD AND HOT PRODUCTS AND METHODS FOR CONSTRUCTING SAME

[76] Inventor: Alf H. Grennard, Bergstrasse 21, 6101 Nieder-Ramstadt, Fed. Rep. of Germany

[21] Appl. No.: 675,210

[22] Filed: Apr. 8, 1976

[30] Foreign Application Priority Data

Apr. 14, 1975 [SE] Sweden ..... 7504236
Feb. 20, 1976 [SE] Sweden ..... 7602003

[51] Int. Cl.[2] ..... F17C 7/02

[52] U.S. Cl. ..... 62/45; 62/260; 73/40.7; 165/45; 405/56

[58] Field of Search ..... 62/45, 260; 165/45; 61/0.5, 36 A; 73/40.7

[56] References Cited

U.S. PATENT DOCUMENTS

| | | | |
|---|---|---|---|
| 3,152,640 | 10/1964 | Marx | 61/0.5 |
| 3,196,622 | 7/1965 | Smith et al. | 61/0.5 |
| 3,274,785 | 9/1966 | Lange | 61/0.5 |
| 3,300,982 | 1/1967 | Meade | 62/45 |
| 3,364,729 | 1/1968 | Yearwood | 73/40.7 |
| 3,489,311 | 1/1970 | Folkerts et al. | 73/40.7 |
| 3,581,513 | 6/1976 | Cranmer | 61/0.5 |
| 3,950,958 | 4/1976 | Loofbourow | 61/0.5 |
| 3,952,531 | 4/1976 | Turner | 62/45 |

*Primary Examiner*—Ronald C. Capossela
*Attorney, Agent, or Firm*—Haseltine, Lake, & Waters

[57] ABSTRACT

In an underground storage, containing hot or cold storage materials, a circulating gas or fluid is passed in a plurality of conducts in the walls, floor, and ceiling of the storage and near their surface towards the storage, and, if a container or containing vessel is constructed inside the walls of said underground storage, the gas or the fluid is conducted either in the mentioned outer wall as previously mentioned or between the wall of the container and the outer rock walls, particularly in the last mentioned case also in ducts or in galleries with guiding devices for the medium to insure a corresponding contact with surfaces involved, or, in some cases, in the interior of said container wall. By controlling the temperature, humidity, and pressure of said circulating medium and creating a pressure differential towards adjacent areas, the stability and the sealing characteristics of the outer wall are greatly improved, the heat influx to the product storage further substantially reduced, the sublimation of ice brought under improved control with a view to prevent damage to the storage wall insulation.

The suggested method, using the envisaged multi-purpose circulating system, also offers further advantages such as a possibility of recovering losses of stored product from leaks and, in addition, increased control and safety, the latter in particular when storing volatile and combustible fluid materials. The design offers an improved method of applying sealants, adding auxiliary products, and removing others from suggested circulating system. New types of sealants are suggested.

16 Claims, 7 Drawing Figures

UNDERGROUND STORAGE FOR COLD AND HOT PRODUCTS AND METHODS FOR CONSTRUCTING SAME

This invention relates in particular to the underground storage of products whose storage temperature as a rule differs from the natural temperature of the underground surroundings in which the storage is located. In one aspect it relates to a method of controlling the temperature of the walls, floor, and ceiling of said underground storage, this storage often being located in rock, and keeping the temperature of these sections within a determined range or at a stipulated figure, using preferably a circulating stream of gas or in some cases a liquid as a medium, which functions as a vehicle for the transportation of heat to or the removal of heat from the mentioned storage walls, floor, and ceiling. As a consequence of said temperature control this invention provides the possibility of establishing a temperature barrier around the area of the circulation system envisaged in this paper, said barrier reducing the ice sublimation process sufficiently for all practical purposes. In still another aspect this invention relates to a method of removing water or other substances from or adding the same to the walls, floor, and ceiling of the underground storage, again using the circulating medium in question as a vehicle, at wish applying pressure or vacuum, said medium also picking up water vapors from sublimed ice.

The invention further relates to a method of recovering products which possibly could leak out from the underground storage into the said circulating system and further provides a safety system of controlling if and to what extent products, in particular volatile combustible products, are escaping from the storage. In another aspect the object of this invention is to provide a method of utilizing the temperature difference between the suggested circulating medium and some other stream or body with a view to economically recover heat or 'cold' calories. The invention also provides a new method of supplying sealants with the aid of said circulating system and also suggests new types of sealants which swell upon contact with the stored products. At the same time it relates to a safer method of regasification of condensed gaseous products. It is an object of this invention to provide for constructing a suitable underground storage for the purposes envisaged, and it therefore incorporates new types of insulation designs withstanding very low cryogenic temperatures and suitable for the invention presented here.

Other objects and advantages will be apparent to those skilled in the art upon study of this disclosure including the detailed description of the invention and the appended drawings wherein.

Figure 3:
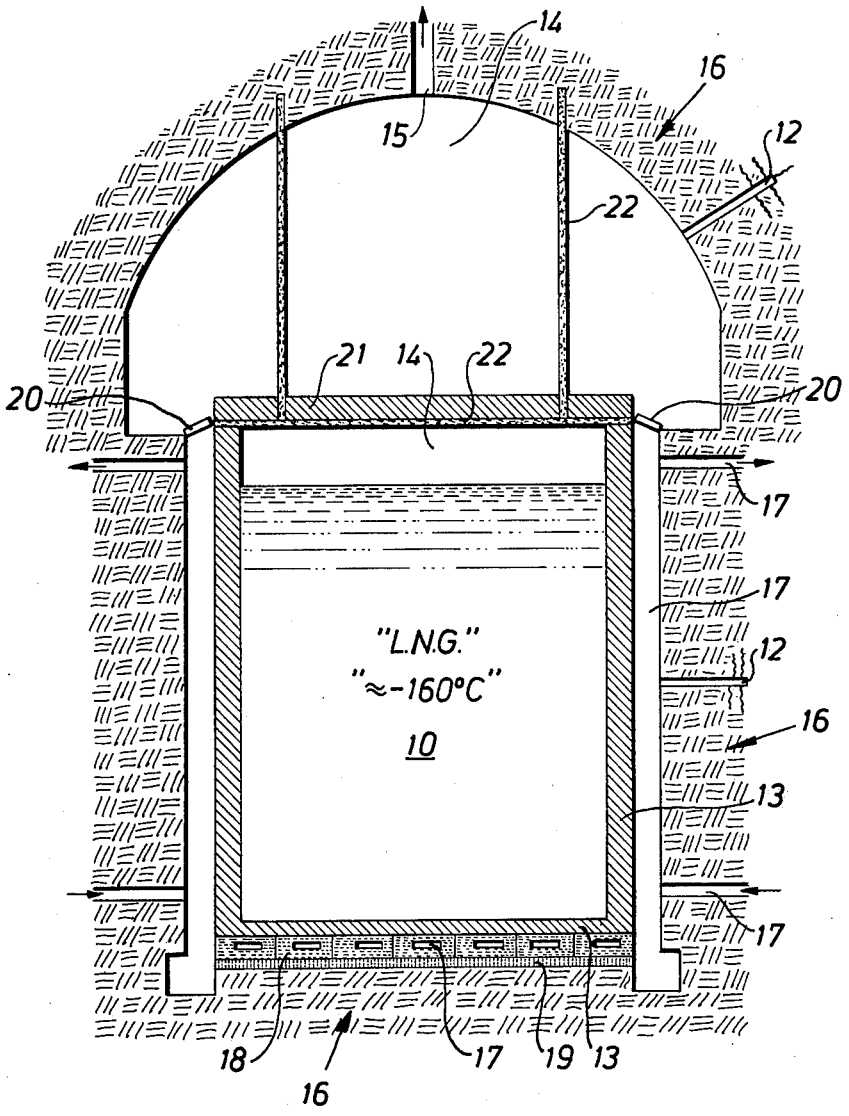

FIG. 3 illustrates a schematic sectional elevation of a vertical underground storage reservoir with a round or rectangular bottom according to a modification of the same invention, showing the plurality of circulation channels, ducts, or galleries with guiding devices for the circulating medium, placed between the actual rock storage wall or a cast concrete wall and the inner storage wall, all latter surfaces being equipped with some type of insulation withstanding large temperature differences (the figure illustrates only the case of a rock cavity).

Figure 4:
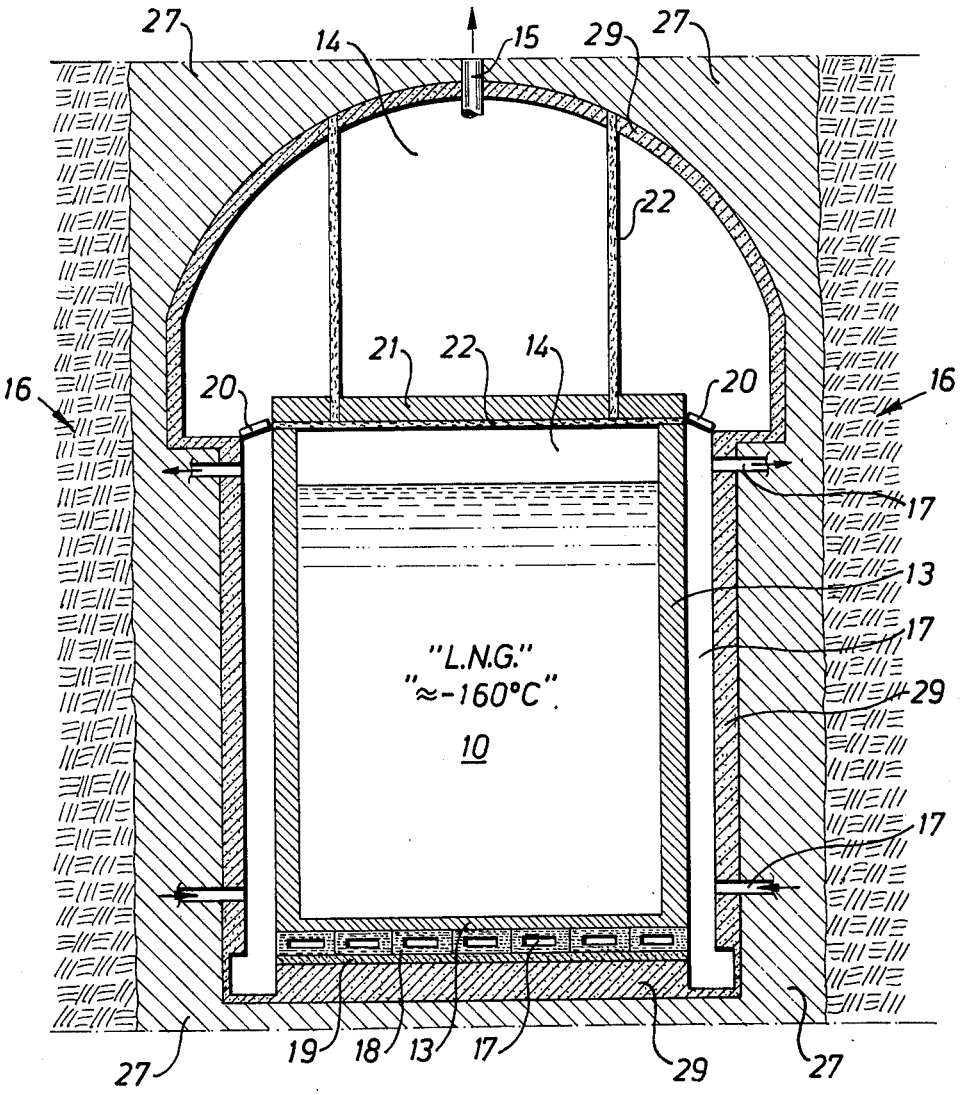

FIG. 4 illustrates a schematic sectional elevation of an vertical underground storage reservoir according to a modification of the same invention, the plurality circulation channels, ducts, or galleries with guiding devices for the circulating medium, being placed between the inner wall and the concrete wall constructed inside of the actual outer rock wall or surroundings of loose materials such as clay, silt, and sand (the figure illustrates the case of a concrete outer cavity 29, surrounded by an insulating material).

Figure 5:
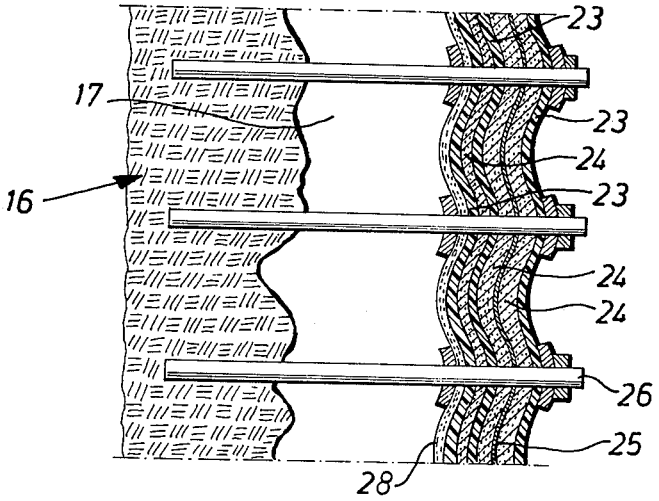

FIG. 5 shows a schematic sectional plan view of one type of insulating design used according to the invention. Insulation is fastened to a system of rods.

Figure 6:
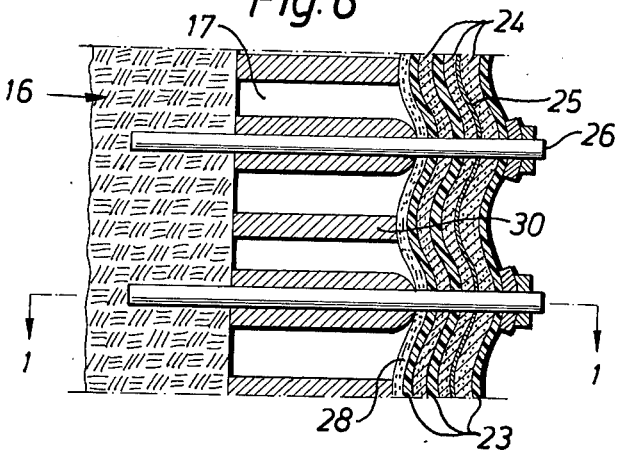

FIG. 6 shows a schematic sectional plan view of another type of insulating design used according to the invention. The insulation is supported by a system of wall laths, which have a repeated regular wave-formed profile, the crest on each vertical lath in the figure being at the same horizontal level on every second lath.

Figure 7:
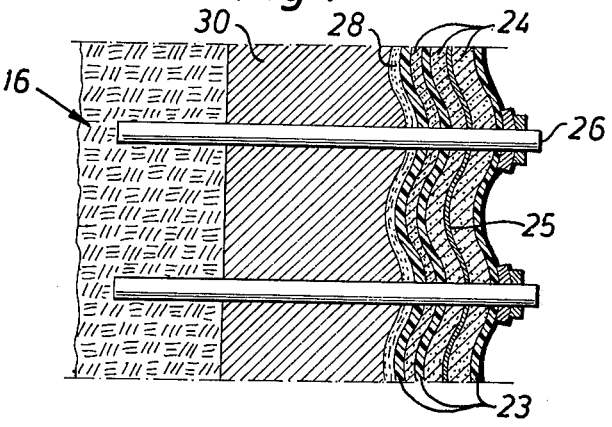

FIG. 7 is a sectional elevation along line 1-1 in FIG. 6.

The principle of this invention offers advantages when storing cold as well as hot products underground. As the most prevalent need of underground storage refers to the storage of cold, combustible products such as Liquefied Petroleum Gases (LPG), Liquefied Natural Gas (LNG), Synthetic Natural Gas (SNG), petrochemical products, and industrial gases, I prefer for illustrative purposes to select the underground storage of LNG as a typical example of the use of my invention though the same principle can for the most part be applied for all types of products which must be stored at temperatures differing from the natural temperatures of the underground environment. For the sake of simplicity mainly the construction of reservoirs in rock is discussed, though the invention also refers to similar storages built of concrete in silt, sand, or a mixture of different materials.

Pipes for the filling and the removal of liquid or gas may be conventional and may not be shown in the drawings. The same goes for some other equipment and instrumentation required. Corresponding parts have been given the same numerals. The type of insulation or its design used in FIGS. 1-4 has not been denoted, likewise the detailed attaching of it to the outer or inner storage wall.

The petroleum industry produces great quantities of volatile hydrocarbons as a result of processing crude oil and natural gas. Natural gas is being liquefied at ports of exportation, stored there, then shipped overseas, and stored at terminals at the port of importation. Stand-by storage facilities are located outside consumption centers and along pipelines. Such liquids require enormous storage facilities, particularly during periods of slack use, for peak-shaving purposes, and on account of requirements stipulated by the authorities for emergency cases such as war and embargos.

Other industrial gases require similar facilities. Great quantities of volatile liquids including propane and butane have in the past been dissolved from impervious formations, stored in earthern storage pits, or in mined underground caverns. Loss of product, the difficulty of providing and maintaining an adequate vapor seal, and excessive heat losses are some of the problems encountered.

The general tendency is to locate storage facilities for combustible gases underground of the following reasons:

1. LNG fires and similar fires of highly volatile liquids cannot be extinguished and are therefore left to burn out. Such fires are also generally accompanied by repeated violent fatal explosions with enormous devastations. When storing such products underground, explosions and other dangers can be prevented, and fires easily controlled and quickly extinguished. Authorities are therefore expected to stipulate underground storage location for such products in the future, particularly with regard to public opinion and other environmental grounds generally presented.
2. Increased protection against wheather, sabotage, and hostile military operations.
3. Storage at constant and low temperature, generally in the range 8–10° centigrade; no exposure to sunlight.
4. No space required above ground.
5. Storage under pressure at low cost.
6. A better and improved understanding lately of the real nature of forces in rock makes it possible to avail oneself of less fortunate locations where the underground rock is of inferior quality. Reservoirs can also be built in sand, silt, or clay, which problem, though, will only be mentioned in this paper.

Though storage of LPG in underground rock reservoirs at temperatures in the range of −40° C to −50° C for a long time has been a successful application the same cannot be said about storage of LNG, SNG, other cryogenic liquefied products like ethane, ethylene, and other petrochemicals, in such underground caverns because the extremely low temperatures required to store these cryogenic products at substantially atmospheric pressure requires an excessive amount of refrigeration on account of the high heat losses incurred. Another drawback has been the increased product losses at these lower temperature levels. The main reason for the mentioned heat losses is the increased amount of contraction with subsequent continued incessant cracking of the underground rock, developing an ever larger seepage of product with time. Further, the intensified rate of sublimation of ice removes the sealing effect of the surroundings and spoils the insulation of the cavity if any.

The mentioned cracking of the rock can continue for years, steadily opening up new cracks and constantly further away out from the storage wall. The natural consequence of the cracking of the rock at these very low temperatures is a continous increase of observed heat influx from the cavity surroundings to the storaged product body, gas seeping out in the environment and causing general nuisance and an explosion danger. There are, of course, always a large number of original cracks in the rock, and these are opened wider up while new cracks are being created sometimes causing large pieces of rock to fall out into the storage cavity. Conventional reinforcements and precautions are therefore always required.

If the temperature of the rock is controlled within determined limits by the aid of the multi-purpose circulating system I have envisaged and which system is located near and along the surfaces of the walls, ceiling, and floor of the underground storage, such continued cracking can be totally avoided at the same time as the stability of the rock material is insured. Difficulties on account of the ice sublimination process, such as damage to insulation applied, are also practically halted, which all can be achieved with the aid of my multi-purpose circulation system, which constitutes the core of this invention. Water vapors thus moving in the direction of the storage may be carried away by the circulation system, and said process substantially reduced by the temperature barrier established by temperature control around the area of the circulating system. Frost heaving and frost lenses are consequences of not removing water by a device such as the one described. Said circulating system consists of a multitude of comparatively closely spaced circulation channels along all surfaces of the storage, the channels carrying a liquid but preferably a gas such as nitrogen, carbon dioxide, possibly hydrogen, or even the stored product itself, or one or several of its components. In some cases ducts, or galleries with devices to direct the circulating stream, may partly or completely substitute a plurality of channels or boreholes. These circulation systems can also be used to heat or chill the rock, which latter operation also will be required when — as described below — sealing the rock at low temperatures in accordance with my proposed method. The typical operating temperature range for the temperature barrier of the rock or concrete will depend on the quality of the rock or concrete but will in most cases be in the range −20° C to −50° C, i.e. about the temperature range used in rock for many current LPG installations.

There exists a patented method which suggests a continous sealing of cracks opened up, applying a freezing liquid, which is continuously injected as the rock cracks. I prefer to start the sealing of natural and potential cracks by first opening up these cracks comparatively wide by chilling the rock through my circulating system to a temperature far below the actual future operating temperature and then apply a sealing material, using pressure and partly distributing the sealing agent by said circulating system. At the same time conventional injection of the same or similar sealing agents may be carried out after a plurality of auxiliary boreholes have been drilled into the surface from the cavity. I prefer to select sealants which swell upon getting in contact with the stored product, though such swelling sealants not always are imperative. If the product should leak out and get in touch with a swelling sealing material in a crack the swelling sealing agent will automatically close the crack firmer. In some instances the swelling action may be started by injection of water. By first injecting a sealing component and then adding a second component and leave the two to react within a closure the swollen material will act as a very good and elastic seal. The described method of first opening up the cracks by chilling the wall material and then apply the sealant by injection after which the cracks are closed again by raising the temperature works as well with rock material as with concrete.

There exists a great number of chemical compounds or mixtures hereof which have the propensity of swelling upon contact with fluids or gases, the fluids and gases being absorbed, adsorbed, dissolved by these materials, or forming new structures with them. Some of these materials are polymers, rubbers, or plastics. The sealant must be selected with regard to the product stored, and selection of proper material can be done by the average expert.

I prefer to remove the water in the rock by using a drying gas or fluid, the latter containing a water absorbing component. These media are circulated in the proposed system and then continously dried by some conventional drying agent. When using a circulating gas, water may also be separated out in condensation, adsorbation, or absorbtion processes, in some cases after compression. The water removal action may be facilitated by first heating the medium. Applying a sealing medium and again taking advantage of the circulating system the sealant is then applied in all cracks and spaces in the environment of the circulating system proposed in this invention. A conventional water drainage system will always be required in all storage designs discussed.

A different mixture, also distributed under pressure through the proposed circulating system in a similar manner as in the previous case, contains principally two components, one of which absorbs water while the other works as a sealant simultaneously. Such products are commercially available. When using the last mentioned mixture the cracks may all be opened up by chilling and partly closed again by raising the temperature.

The sealing qualities of the storage cavity walls are at times dependant on the water content in the rock. Of this reason this invention also involves the idea of adding water to the circulating stream when necessary. For the process of sublimation of ice in the rock the possibility of controlling the water content of the circulating stream is of utmost importance, because water from the rock tends to migrate and form ice on the inside wall of the actual storage, thereby having a tendency of pushing away applied insulation or damaging its valuable insulating characteristics.

It is also an object of this invention to provide a safety system which allows a good control of the proper functioning of the storage, which fact is of prime importance if the cavity contains a volatile combustible liquid or else a dangerous gas. This can be achieved by keeping the operating pressure of the circulating system somewhat lower than the pressure in the actual storage. If product should leak out from the storage it will enter the circulating system where it immediately can be sensed by a suitable instrument such as a gas chromatograph or mass spectrometer. Such a product may then also be recovered, e.g. through absorbtion or condensation processes. In the case of combustible gases it would involve a direct danger not to use such a system or a similar device, should the sealing qualities of the cavity wall prove to be insufficient, needless to mention difficulties which arise at shut-down or maintanance of the storage.

The selection of a suitable medium to be employed for the circulation system depends very much upon product stored, its storage temperature, operating temperature range of the circulating medium, and what type of equipment the medium shall have to pass. A furthur point is the question if the circulating medium may affect materials contacted in the system. Among the gases, nitrogen, which is inert and often employed in start-up operations, is excellent. Another suitable gas may be carbon dioxide, hydrogen, refinery off-gases, and the product itself, if volatile. If natural gas is stored, nitrogen is a suitable medium, and in this case LNG and its components can be separated out completely, if product should leak into the circulating system, as long as the product does not contain hydrogen.

A further point which always arises is if the operating situation allows an economical heat exchange between the circulating medium and some other stream or body.

Underground storage offers the advantage of operating at a higher pressure at low cost as compared with storage above ground. This may be important when filling the storage with LNG liquid, when the specific gravity of the liquid to be filled differs somewhat from the specific gravity of the storage content. Under such circumstances the pressure in the reservoir may rise suddenly on account of so called roll-over.

With regard to the same advantage to operate at higher pressures a further feature of this invention is the suggested use of the reservoir as an evaporation chamber. The heat exchange equipment for the evaporation can be located inside as well as outside the reservoir. The corresponding heat exchange equipment for this evaporation of liquid has not been denoted in the drawing and may be conventional.

When storing cryogenic products like LNG the contraction of the plastic insulations used amounts to about one per cent, while the corresponding contraction of the rock for the same temperature interval will be in the order of one per mille. The contraction differences for these two different materials therefore call for special types of insulation designs to be employed along the cavity walls, on wooden or some other supports along the same walls, or on the walls of a built-in containing vessel. The basic design principle is to prevent the insulation from becoming subject to excessive tensile stress. The insulation designs proposed here are all built up of several layers, e.g. of polyuretan insulation or similar plastics, along with sealing membranes, and a heat reflecting aluminium foil. Suitable sealing membranes and suitable insulating materials are known and commercially available. The designed final compound insulation layer is formed in such a way that the layer is divided up in equidistant cuplike elements, resulting in regular parallel rows of such elements, where each element is equidistant to any next element. There is an ample amount of insulation material around each element to allow for temperature contractions, which mainly result in flexural stresses instead of tensile stresses. The insulation is supported at the centre of each element. The first mentioned stresses again can be mitigated or relieved during the initial transition process at start-up by supplying heat to the outside of the insulation layers, using my proposed circulation system as a heat source.

The application of such insulation designs can easily be carried out on comparatively even wall surfaces but will otherwise require a system of support rods. When supporting the insulation with the aid of a system of laths with wave-formed profiles the cost will be lower when the cavity surface is even and smooth.

The support rods are fixed in boreholes, drilled into the rock, or cast in the concrete wall. These boreholes form a regular symmetric equidistant pattern, evenly distributed along all walls. Each element of the insulation is thereafter fastened on these fixed rods, leaving a 'valley' around each rod to allow for temperature contraction. This design makes it possible to leave the actual rock wall in a rough unfinished condition.

The system of wooden laths is fixed to the rock walls in such a manner tht the crest of a wave profile on one vertical lath is opposite to the 'valley' of a profile of the next adjacent vertical lath at the same horizontal level. When cooled the insulating layers will thus through contraction mainly rest on the crests of all laths, the surplus length of the insulation round each crest allowing for the temperature contraction in conformity with what also happens when the insulation is fastened on the rods mentioned in the previous paragraph. In the last mentioned design the elements referred to correspond to the crests in the lath system.

The two insulation designs can be fitted with wooden supports, if so required and the circulating medium can bbe directed between the insulated inner wall and the actual outer rock or concrete wall. The designs constitute a built-in container. In the figures is the plastic insulation cover over bolts and bolt heads omitted.

Figure 1:
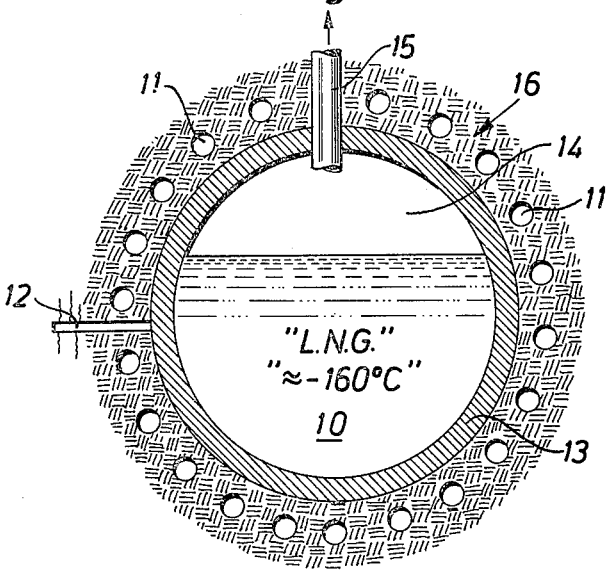
FIG. 1 is a schematic sectional view in elevation of an horizontal cylindric or rounded type of underground storage reservoir according to the invention with a plurality of boreholes for the circulation system, drilled near and along the rock surface of the cavity, or cast in a concrete wall inside a cavity in e.g. silt, clay, or sand (the figure illustrates only the case of a rock cavity).

Referring now to FIG. 1 of the drawing an horizontal rounded type of underground reservoir 10 is shown in cross section. A series of boreholes 11 have been drilled in the rock 16 along the periphery of the reservoir for the circulation system described, from both ends of the cavity, or, depending on length of storage, also from niches between the ends of the reservoir. If a concrete wall has been cast inside the rock wall or in surrounding loose material like clay or sand, the system of holes are cast. Small size boreholes 12 have also been drilled in from the storage (only one such borehole is shown in the drilled in from the storage (only one such borehole is shown in the figure) with a view to tighten cracks through the injection of swelling sealants or other materials after the rock has been cooled down below the future operating temperature. Other cracks have been mended with plastics, cement, or similar mixtures, and the outer cavity surface, depending on the type of insulation used, smoothed. After rock bolts and insulation supports have been positioned the insulation 13 is fastened. 14 is evaporation space, and 15 withdrawal pipe for gaseous products.

Figure 2:
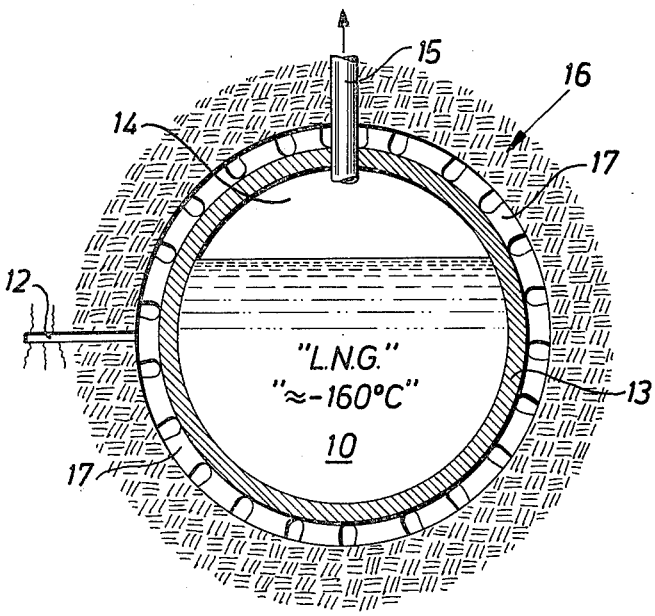
FIG. 2 illustrates a schematic sectional elevation of an horizontal cylindrical or rounded type of underground storage reservoir according to a modification of the same invention with a plurality of circulation channels between the actual rock storage wall or a cast concrete wall and the inner insulated storage wall (the figure illustrates only the case of a rock cavity).

FIG. 2 illustrates how a circulation system of channels 17, placed on the inside of the outer cavity wall, may substitute the circulating system of drilled boreholes in the rock wall of the reservoir 10 as described in FIG. 1. The insulation 13 is here fastened in conformity with what has been outlined in connection with FIGS. 5 or 6. Sometimes it will be cheaper to construct galleries with directing devices for the circulating medium.

The reservoir 10 in FIG. 3 is a modification of the previous two storage types described. This storage may be built according to choice with a rectangular or circular concrete bottom 19, this type of bottom being equipped with circulation channels 17, preferable in block elements of balsa wood 18. The circulation system along the walls consists of a plurality of vertical channels 17 or other gas stream guiding devices which insure a sufficient contact between the streaming medium and the outer and inner wall. While walls and bottom are equipped with the mentioned standard types of insulation 13, the ceiling of the reservoir, rsting on a suspended structure 22, is insulated with some pervious loose insulation like rock wool, which permits the vapors to pass and the possibility to use the cavity as an evaporation chamber. Valve 20 is used at start-up.

FIG. 4 corresponds to FIG. 3 and illustrates how a reservoir can be built in sand, silt, clay, or similar loose materials, or elsewhere where only inferior rock is available. The reservoir, including the walls with the built-in circulation system, is cast in concrete 29, using a travelling mould. Another method is to construct the storage using prefabricated elements and pre-stressed concrete. Construction in earth is generally preceded by freezing the surrounding soil before excavation. When required insulating material, impervious insulating material, or foamed insulating material 27 may be filled in round the structure.

FIG. 5 shows how the insulation 13 is fastened after a regular pattern of equidistant support rods has been positioned in the rock wall. 23 are elastomeric membranes, 24 polyuretane foam, 25 aluminium foil, and 26 support rod, which has been fixed in a hole drilled in the rock or in the concrete. 28 is an optional support of wood, plywood, or plastic.

FIG. 6 illustrates the utilization of a system of laths 30 with a configuration of regularly repeated wave-like profiles.

FIG. 7 is a sectional elevation along line 1-1 in FIG. 6.

That which is claimed is:

1. A method of storing a product below 0° C in an insulated reservoir at a temperature which differs from natural ambient temperature of the surrounding walls, floor and ceiling forming said reservoir and its environs, said method including the steps of: providing said reservoir with a circulation system employing a plurality of parallel channels formed within and proximate to surrounding wall surfaces about and below said reservoir; introducing a gaseous heat exchange medium under slight vacuum with a capacity of absorbing moisture within said channels and causing said medium to circulate therein for heat transfer from said surfaces surrounding said circulating system; forming a temperature barrier between the wall surfaces of said reservoir and the external environment, by supplying heat through a continuous heat exchange between said medium and the surrounding areas of said circulation system to cause the temperature of said areas to be maintained at a higher level than that of said product in said reservoir; said product within said reservoir below 0° C and varying the temperature gradient level to a value in excess of said product temperature; and continuously removing existing water vapor from sublimated ice and water by means of circulating of said heat exchange medium.

2. The method of claim 1, applied to an underground reservoir.

3. The method of claim 1 wherein the said circulating medium is a liquid.

4. The method of claim 1 wherein the said circulating medium is a gas.

5. The method of claim 1 wherein said circulating medium is nitrogen.

6. The method of claim 1 wherein the said circulating medium is formed the stored product itself.

7. The method of claim 1 wherein the said circulating medium is used to remove water from the surroundings of the circulating system.

8. The method of claim 1 wherein the circulating medium is used as a vehicle to distribute a substance throughout the circulating system and its surrounding area.

9. The method of claim 1 wherein the temperature difference between said circulating stream and another stream or body is utilized for heat exchange.

10. The method of claim 1 wherein the circulating stream is used to chill the surroundings of the circulating system below the normal operating temperature causing cracks to open wide before injection of sealing materials the walls, ceiling, and floor of the reservoir.

11. The method of claim 1 wherein the sealing materials used have the ability to swell upon contact with the product stored.

12. The method of claim 1 wherein the sealing materials used have the ability to swell upon contact with water.

13. The method of claim 1 wherein the reservoir is used as an evaporation chamber for the product stored.

14. The method of claim 1 wherein the stored liquid product is used as a heat exchange medium for the evaporation of liquid stored.

15. The method of claim 1 wherein the product is stored at sub atmospheric temperature and is at least partly liquefied.

16. The method of claim 1 wherein the reservoir is located in rock.

* * * * *

UNITED STATES PATENT AND TRADEMARK OFFICE

CERTIFICATE OF CORRECTION

PATENT NO. : 4,121,429

DATED : October 24, 1978

INVENTOR(S) : Alf H. Grennard

It is certified that error appears in the above—identified patent and that said Letters Patent is hereby corrected as shown below:

Column 7, line 17, "bbe" should read -- be --;

lines 31 and 32, "only one such bore-hole is shown in the drilled in from the storage" should be deleted.

Signed and Sealed this

Second Day of December 1980

[SEAL]

Attest:

SIDNEY A. DIAMOND

Attesting Officer

Commissioner of Patents and Trademarks